US010945519B2

(12) United States Patent
Chacker

(10) Patent No.: US 10,945,519 B2
(45) Date of Patent: Mar. 16, 2021

(54) GARMENT CONVERTIBLE INTO A SELF-CONTAINED BAG

(71) Applicant: Evan D. Chacker, Honolulu, HI (US)

(72) Inventor: Evan D. Chacker, Honolulu, HI (US)

( * ) Notice: Subject to any disclaimer, the term of this patent is extended or adjusted under 35 U.S.C. 154(b) by 0 days.

(21) Appl. No.: 16/268,884

(22) Filed: Feb. 6, 2019

(65) Prior Publication Data

US 2020/0245749 A1 Aug. 6, 2020

(51) Int. Cl.

| | |
|---|---|
| ***A41D 15/04*** | (2006.01) |
| ***A45F 4/12*** | (2006.01) |
| *A45F 4/00* | (2006.01) |
| *A41D 27/20* | (2006.01) |

(52) U.S. Cl.

CPC ..... *A45F 4/12* (2013.01); *A41D 15/04* (2013.01); *A41D 27/201* (2013.01); *A41D 2400/48* (2013.01); *A45F 2004/003* (2013.01)

(58) Field of Classification Search

CPC ..... A41D 15/04; A41D 2400/422; A41D 2300/322; A41D 27/204; A45F 4/12; Y10S 2/913; A45C 9/00; A45C 2009/007

See application file for complete search history.

(56) References Cited

U.S. PATENT DOCUMENTS 1,999,010 A * 4/1935 Tait ..... A41D 7/00 450/30
2,072,030 A * 2/1937 Damron ..... A41D 15/00 2/87
3,818,158 A * 6/1974 Nakanishi ..... A41D 15/04 2/48
4,055,853 A * 11/1977 Argento ..... A41D 3/00 2/93
4,060,853 A * 12/1977 Gabarro ..... A41D 15/04 2/108
4,103,377 A * 8/1978 Mayer ..... A41D 15/04 2/69.5
4,214,383 A * 7/1980 Allen ..... A43B 3/102 36/1
4,301,547 A * 11/1981 Bloise ..... A41D 3/08 2/88
4,347,629 A * 9/1982 Itoi ..... A41D 3/00 2/108
5,077,838 A * 1/1992 Senser ..... A41D 15/00 2/102
5,165,111 A * 11/1992 Lieberman ..... A41D 15/04 2/108
5,226,193 A * 7/1993 Chen ..... A41B 13/06 2/69
5,278,998 A * 1/1994 Book ..... A41D 13/0012 190/1
5,407,112 A * 4/1995 Christodoulou ..... A41D 15/04 2/94
5,564,125 A * 10/1996 Waldman ..... A41D 3/00 2/93

(Continued)

*Primary Examiner* — Brian D Nash
(74) *Attorney, Agent, or Firm* — Charter IP LLC

(57) ABSTRACT

In a garment convertible into a bag for stowage and transport, there is a base garment, and a pair of pockets attached thereto. The two pockets are joined together with a zipper fastener that attaches mating teeth halves on the respective pockets so as to be zipped continuously around the connected pockets to form a bag therein, the material of the base garment adapted so as to be folded for insertion in the bag.

16 Claims, 8 Drawing Sheets

(56) References Cited

U.S. PATENT DOCUMENTS 5,592,691 A * 1/1997 Ronald ..... A41D 15/00 2/243.1
5,664,257 A * 9/1997 Hall ..... A41D 15/04 2/106
5,787,504 A * 8/1998 Wu ..... A41D 15/04 2/93
6,275,993 B1 * 8/2001 McCarley ..... A41D 3/08 2/209.11
6,336,226 B1 * 1/2002 Garcia ..... A41D 15/04 2/227
6,370,692 B1 * 4/2002 Duyn ..... A41D 3/02 2/86
6,405,377 B1 * 6/2002 Davis ..... A41D 15/04 2/108
6,817,031 B1 * 11/2004 Gravlin ..... A41D 1/00 2/67
6,851,127 B1 * 2/2005 Khan ..... A41D 13/00 2/84
8,429,763 B2 * 4/2013 Hawbaker ..... B65D 33/28 2/86
9,022,269 B1 * 5/2015 Woodcock ..... A45F 4/00 224/576
9,554,601 B2 * 1/2017 Arajakis ..... A41D 3/005
10,477,905 B1 * 11/2019 Sachs ..... A41D 27/202
2002/0040493 A1 * 4/2002 Wooley ..... A41D 15/04 2/102
2005/0251896 A1 * 11/2005 Donlan ..... A41D 1/06 2/269
2008/0134408 A1 * 6/2008 Kantor ..... A41D 15/04 2/102
2009/0034882 A1 * 2/2009 Chih ..... A41D 15/04 383/2
2009/0183529 A1 7/2009 Modiano
2014/0331381 A1 * 11/2014 Arajakis ..... A41D 15/04 2/84
2015/0150319 A1 6/2015 Walmsley
2015/0196077 A1 * 7/2015 McIntire, Jr. ..... A41D 13/0518 2/2.5
2016/0338425 A1 * 11/2016 Virgilio ..... A41D 1/02
2017/0231299 A1 * 8/2017 Feterman ..... A45C 3/06 224/153
2018/0140026 A1 * 5/2018 Nijmeh ..... A41D 19/01529
2019/0380403 A1 * 12/2019 Schwirtz ..... A41D 15/002
2020/0000156 A1 * 1/2020 Neuhaus ..... A41D 1/02
2020/0093245 A1 * 3/2020 Romano ..... A41D 27/20
2020/0107594 A1 * 4/2020 Kilchoer ..... A45C 13/02

* cited by examiner

GARMENT CONVERTIBLE INTO A SELF-CONTAINED BAG

BACKGROUND

Field

The example embodiments in general are directed to garments convertible into a smaller profile within a self-contained bag for stowage and transport.

Related Art

When traveling on vacations, business, etc., it is desirable to reduce the amount of luggage that accompanies the traveler. To maximize space during travel, articles of clothing that can be reduced in size from a larger bulky profile to a size that might be placed in a carry pouch or bag are desirable. As such, convertible garments have been developed which convert selected garments into bags or pouches for ease of packing and transport, and/or for a quick transition into another outfit without having to lug around a piece of luggage on outings.

U.S. Pat. Appl. Publ. No. 2009/0183529 to Modiano is directed to a prior art garment with an integral storage pocket that can be folded in layers into a smaller profile within the integral pocket for carry and storage. In Modiano, the garment is knitted from superfine or microfibers, such that its fabric is elastic. The garment includes an integral pocket with a pocket perimeter in which the garment can be retained. A first section of the pocket perimeter is attached to the garment and a second section forms a mouth of the pocket. This configuration is such that the length of the pocket mouth is less than the maximum length of the pocket. The integral pocket is stretchable to enable it to envelop the garment and retain it within as a compact package.

U.S. Pat. Appl. Publ. No. 2015/0150319 to Walmsley is directed to another prior art garment that can be folded or rolled into a carry bag with a carrying strap, the strap being formed by part of the garment. In Walmsley, a long sleeve garment has a front and back side, each having an upper and lower section. The lower section has attachment elements and the back has spaces for securing the attachment elements to close the lower section of the garment. The upper section includes two arm sections that are joined together to form the carrying strap.

Another prior convertible garment for stowage is describe in U.S. Pat. No. 6,817,031 to Gravlin. FIG. 1 of Walmsley is a perspective view of a garment convertible into a pouch; FIG. 2 shows how the top is folded for insertion into one of the pockets; FIG. 3 shows the garment in a partially stowed position with the zipper one-third closed and the legs being folded up against the pockets; and FIG. 4 shows a final pouch configuration with the garment contained within the pouch for stowage and transport.

Referring to FIGS. 1-4, Walmsley describes a garment 20*b* (shorts) having a pair of pockets 30, each located on a respective left side and right side of the shorts 20*b* at each leg 28, just at or just below the hips. For each pocket 30, a zipper fastener 22 borders three consecutive fixed edges of pocket 30. A tie fastener 24 is disposed on the open top side of each pocket 30. The tie 24 is adapted to releasably constrict the opening of the pocket 30.

To reduce the shorts 20*b* into a closed pouch configuration 20, the shorts 20*b* are folded to approximate the pockets 30, with the pin of male zipper stringer 22*a* being inserted into the slider of female zipper stringer 22*b* and a zipper tab 22*c* pulled to begin mating the zipper fastener 22, as shown in FIG. 3. This action forces the shorts 20*b* into a contracted, folded arrangement, reducing the total surface area exposed. FIG. 3 shows the zipper tab 22*c* being pulled approximately one-third of the way around zipper 22. The shorts 20*b* are folded, first by pleating the sides of the shorts 20*b* into the center region, then by folding the legs 28 up to the center region, and finally by folding the waistband 26 down over the legs 28. Once the shorts 20*b* are folded, in a compact state, the user is able to easily pull zipper tab 22*c* along the zipper 22 from one end to the other to achieve the pouch configuration 20 shown in FIG. 4.

Thus, Gravlin describes a garment convertible into a pouch, the garment having two-pockets. Each of the two pockets have an open top side and three edges that fixed to the side of the garment and have corresponding zipper stringers bordering the three fixed side edges. As the zipper halves are mated, the three edges join together to form a pouch, with the garment folded between the pockets.

SUMMARY

An example embodiment of the present invention is directed to garment convertible into a bag for stowage and transport. The garment includes a base garment of a single-walled construction and having a front, a back and opposing sides, and a pair of pockets. Each of the two pockets has a single-walled construction and includes a mating teeth halve of a zipper fastener arranged around an entire perimeter of the pocket and attached to the base garment, each pocket further having at least one opening between the base garment and material of the pocket within the perimeter bounded by the mating teeth halve. The two pockets are joined by attaching the mating teeth halves of the zipper fastener so as to be zipped continuously around the connected pockets to form a bag therein, the material of the base garment being folded for insertion in the bag. One or both pockets includes a separate zipper formed therein in addition to the pocket formed in the opening between the base garment and material of the pocket within the perimeter bounded by the mating teeth halve.

Another example embodiment is directed to a garment convertible into a bag for stowage and transport. The garment includes a base garment made of a pliable and foldable material and a pair of pockets attached thereto, each of the two pockets formed of the same pliable and foldable material as the base garment. The two pockets are joined together with a zipper fastener that attaches mating teeth halves on the respective pockets so as to be zipped continuously around the connected pockets to form a bag therein, the material of the base garment adapted so as to be folded for insertion in the bag. One or both pockets have a separate zipper bag formed therein.

Another example embodiment is directed to a garment convertible into a bag for stowage and transport. The garment includes a base garment of a single-walled construction and made of a given material and a pair of pockets attached thereto. Each pocket is made of the same material as the base garment with each pocket serving as an opening between the base pocket and material of the pocket attached to the base garment. The two pockets are joined together with a zipper fastener attaching the pockets together and zipped continuously around the connected pockets to form a bag therein, the given material of the base garment adapted so as to be folded for insertion in the bag, wherein one or both pockets includes a separate zipper formed therein.

BRIEF DESCRIPTION OF THE DRAWINGS

Example embodiments will become more fully understood from the detailed description given herein below and the accompanying drawings, wherein like elements are represented by like reference numerals, which are given by way of illustration only and thus are not limitative of the example embodiments herein.

DETAILED DESCRIPTION

Figure 1:
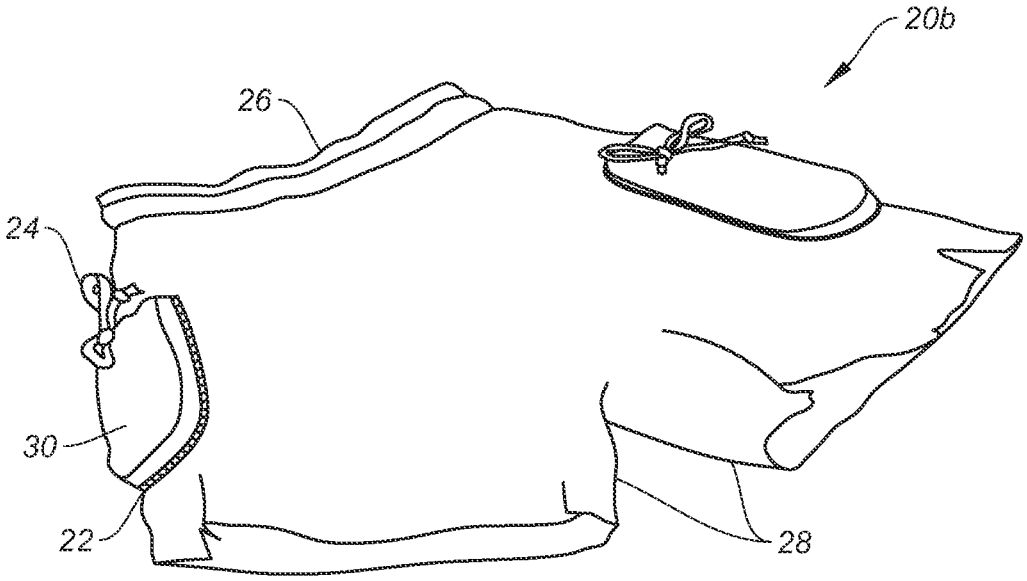
FIG. 1 (Prior Art)
FIG. 1 is a perspective view of a prior art convertible garment that is convertible into a bag.
Figure 2:
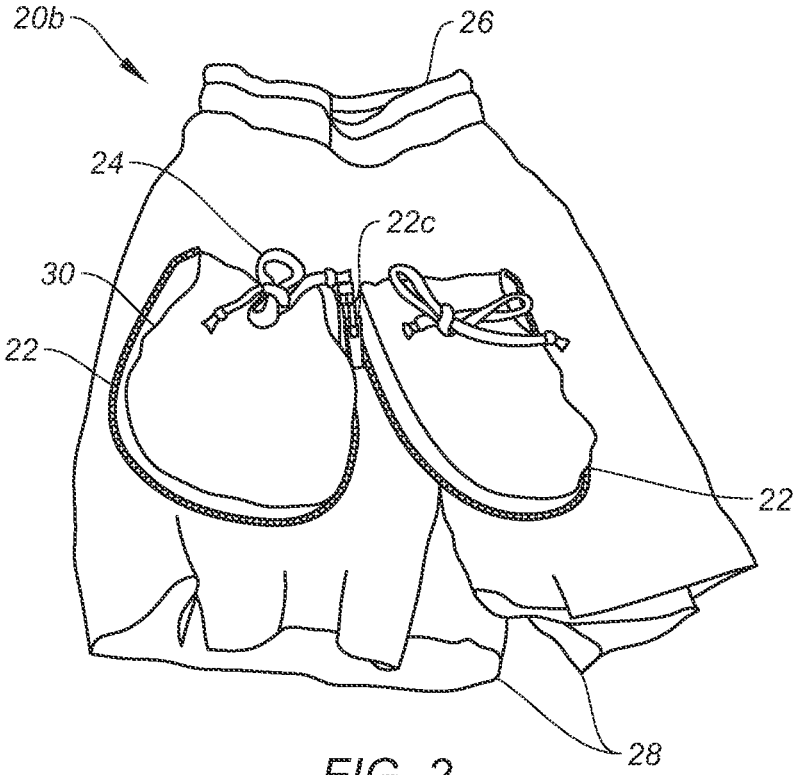
FIG. 2 (Prior Art)
FIG. 2 shows how the top of the prior art convertible garment of FIG. 1 is folded for insertion into one of the pockets
Figure 3:
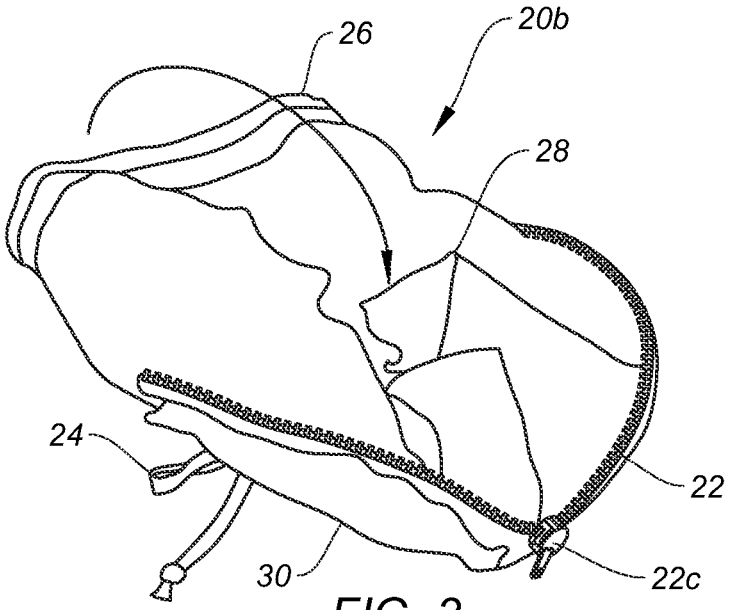
FIG. 3 (Prior Art)
FIG. 3 shows the prior art convertible garment of FIG. 1 in a partially stowed position with the zipper one-third closed and the legs being folded up against the pockets.
Figure 4:
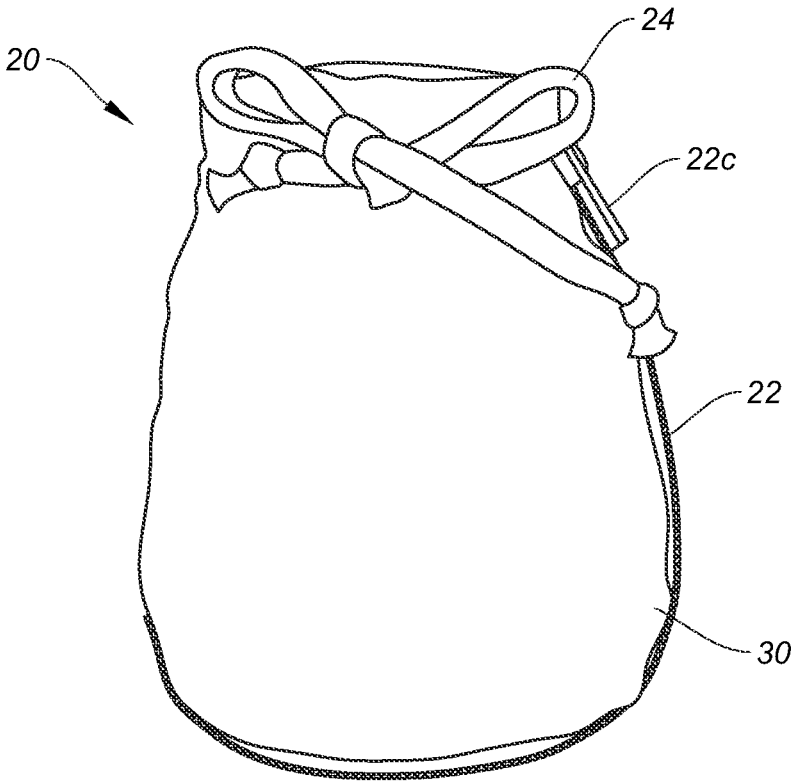
FIG. 4 (Prior Art)
FIG. 4 shows a final bag configuration with the prior art convertible contained within the bag for stowage and transport.

In the following description, certain specific details are set forth in order to provide a thorough understanding of various example embodiments of the disclosure. However, one skilled in the art will understand that the disclosure may be practiced without these specific details. In other instances, well-known structures associated with manufacturing techniques have not been described in detail to avoid unnecessarily obscuring the descriptions of the example embodiments of the present disclosure.

Unless the context requires otherwise, throughout the specification and claims that follow, the word "comprise" and variations thereof, such as "comprises" and "comprising," are to be construed in an open, inclusive sense, that is, as "including, but not limited to."

Reference throughout this specification to "one example embodiment" or "an embodiment" means that a particular feature, structure or characteristic described in connection with the embodiment is included in at least one embodiment. Thus, the appearances of the phrases "in one example embodiment" or "in an embodiment" in various places throughout this specification are not necessarily all referring to the same embodiment. Further, the particular features, structures or characteristics may be combined in any suitable manner in one or more example embodiments.

As used in this specification and the appended claims, the singular forms "a," "an," and "the" include plural referents unless the content clearly dictates otherwise. The term "or" is generally employed in its sense including "and/or" unless the content clearly dictates otherwise.

As used in the specification and appended claims, the terms "correspond," "corresponds," and "corresponding" are intended to describe a ratio of or a similarity between referenced objects. The use of "correspond" or one of its forms should not be construed to mean the exact shape or size. In the drawings, identical reference numbers identify similar elements or acts. The size and relative positions of elements in the drawings are not necessarily drawn to scale.

Referring now to FIGS. 5 through 12, there is shown a garment convertible into a self-contained bag, hereafter referred to as a "convertible garment 100" or "garment 100". Showed in its open and wearable orientation in FIG. 5, convertible garment 100 includes a pair of pockets 130*a* and 130*b* in spaced relation thereof on a base garment 120, here shown as a pair of shorts 120 for purposes of explanation only. The pockets 130*a/b* may be arranged on a front panel of a garment 120, a rear panel of a garment, and/or on sides of a garment 120.

Figure 5:
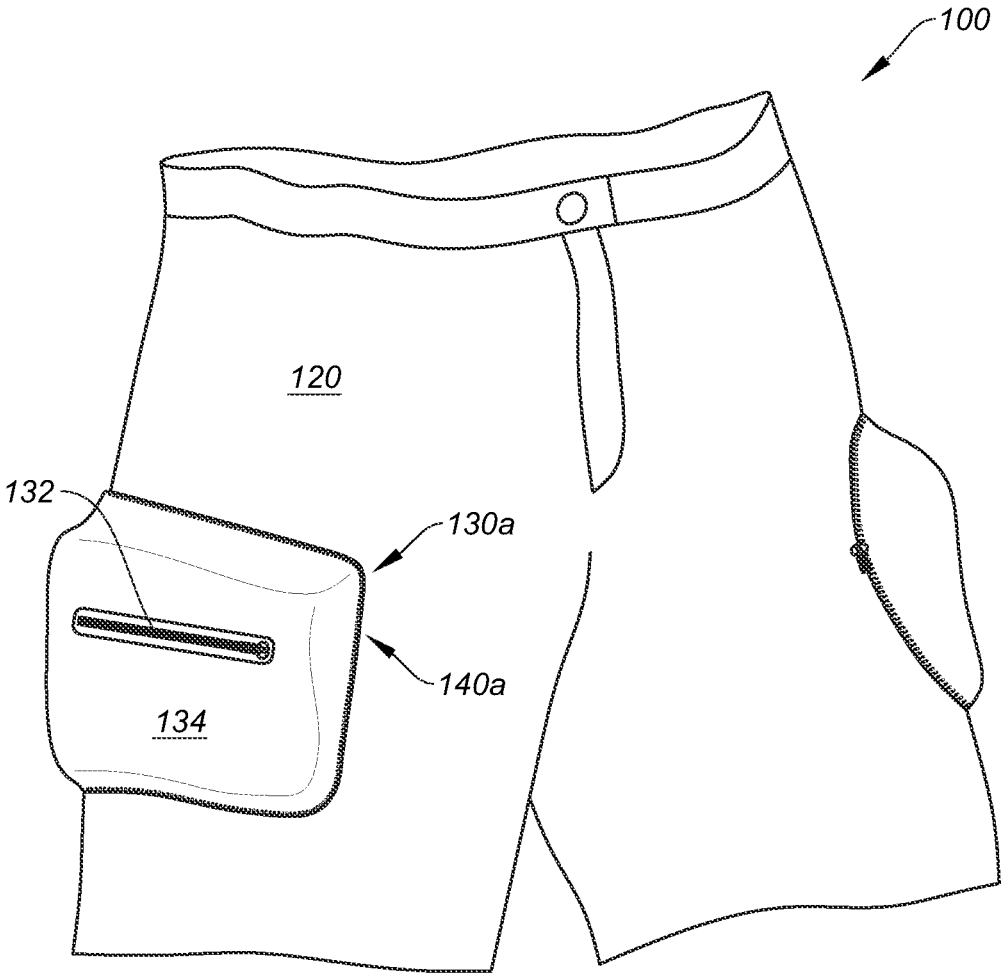
FIG. 5 is a front plan view of an example garment convertible into a self-contained bag for stowage and transport according to an example embodiment.

In FIG. 5 the shorts 120 are fully unfolded, the pockets 130*a* and 130*b* are disposed on the left and right sides on a front panel of shorts 120. Each pocket 130*a/b* is formed in an opening between the material of shorts 120 and material of the pocket itself. In an example, each pocket 130*a/b* may have an external zipper 132 arranged on an outer surface for interior access with convertible garment 100 in a wearable orientation, and an additional external pocket 134. The external pocket 134 includes loose material that provides additional external storage and security.

Figure 6:
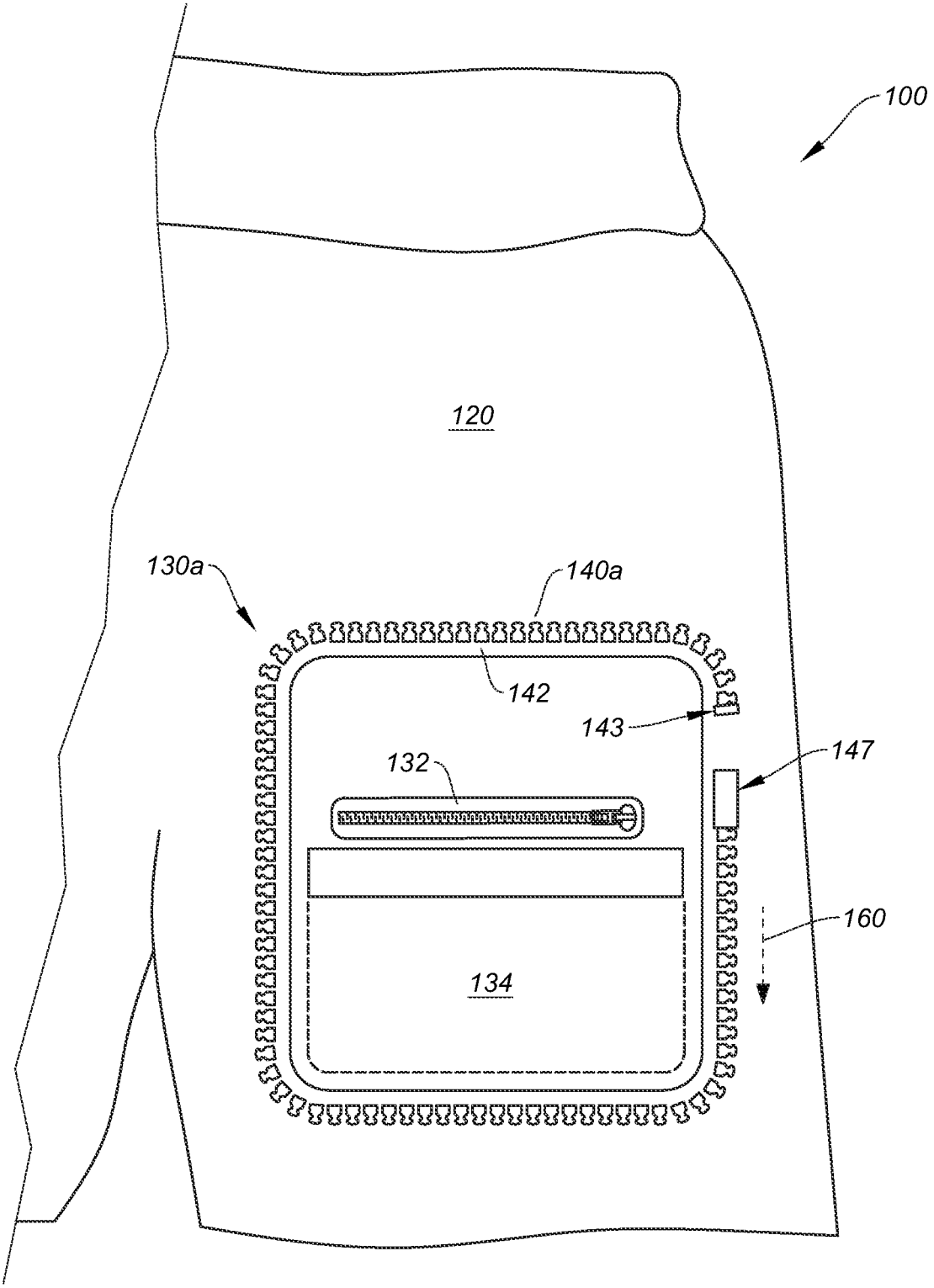
FIG. 6 is enlarged front view of a portion of the base garment showing the pocket structure thereon.

Of note, around each pocket 130*a/b* there is a mating zipper halve 140*a/b* formed on tape 142 that in turn is attached (sewed, adhered, etc.) to material of the garment 120. Each mating zipper halve 140*a/b* is thus arranged so as to bound the outside or perimeter of each pocket 130*a/b*. In FIG. 6, arrow 160 shows an example closure direction for a zipper fastener to connect the two pockets together so as to form a bag containing the shorts 120 therein, a "self-contained bag".

Figure 7:
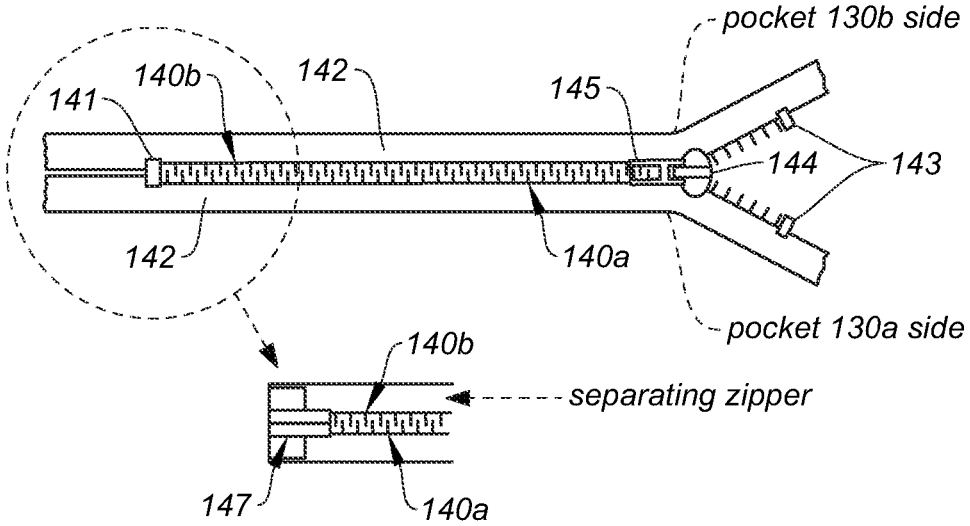
FIGS. 7 and 8 are enlarged views of the pockets and zipper fastener to show relationships between mating teeth halves on the respective pockets in more detail.
Figure 8:
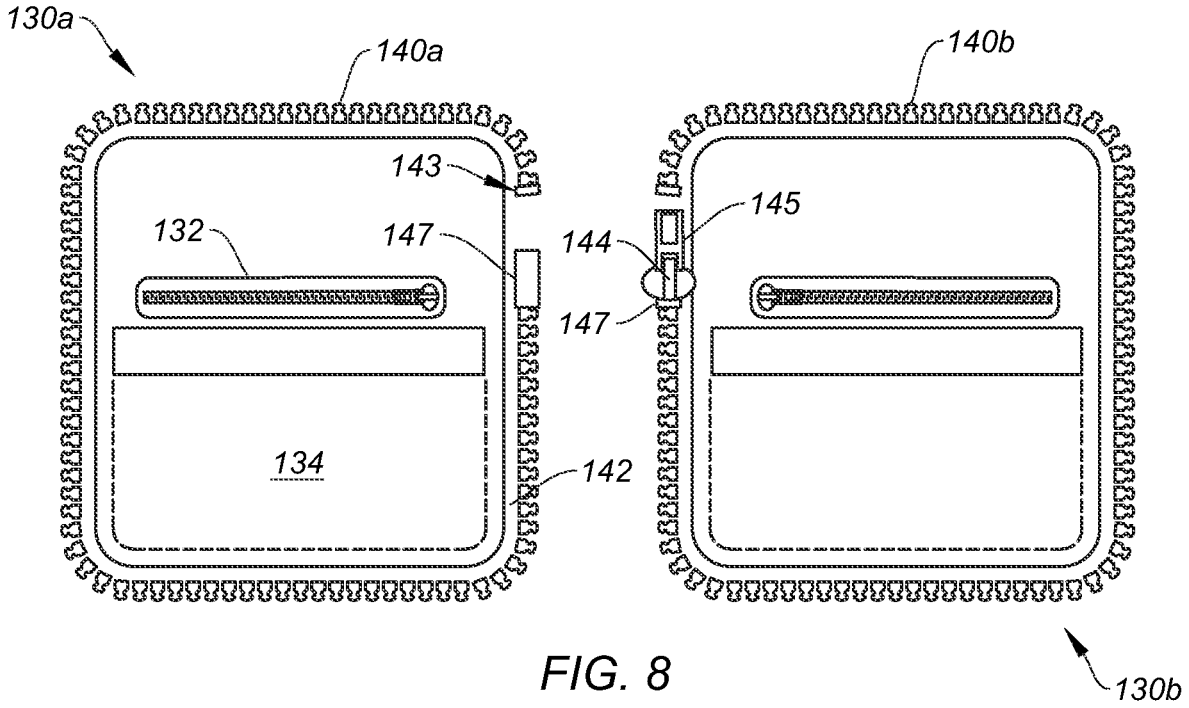

Referring to FIGS. 7-12, a sequence of forming the bag and stowing the shorts 120 therein to form the convertible garment 100 (in a stowed orientation) is described. As best shown in FIGS. 7 and 8, the mating teeth halve 140*b* on pocket 130*b* includes a slide body 144 connected thereto and a pull tab 145 connected to the slide body 144. The mating teeth halve 140*a* on pocket 130*a* includes a slide pin 147 at a proximal end thereof for insertion into the slide body 144 attached to the mating teeth halve 140*b*, so that the pockets 130*a/b* can be attached together as a zipper chain, the zipper fastener zipping up the chain to form the self-contained bag with a temporary opening 135, the distal end of each mating zipper halve 140*a/b* terminating at a stop 143. Accordingly, the two pockets 130*a/b* are joined by attaching one mating teeth halve 140*b* to the other mating zipper halve 140*a* with the zipper fastener comprising the slide body 144 (to be attached via slide pin 147 of mating teeth halve 140*a*). The fastener is then pulled via pull tab 145 so that the chain of teeth is formed by the connected mating halves 140*a/b*; the zipper fastener is zipped or pulled continuously around the connected pockets 130 *a/b* to form the bag that eventually contains the material of garment 120 therein.

Figure 9:
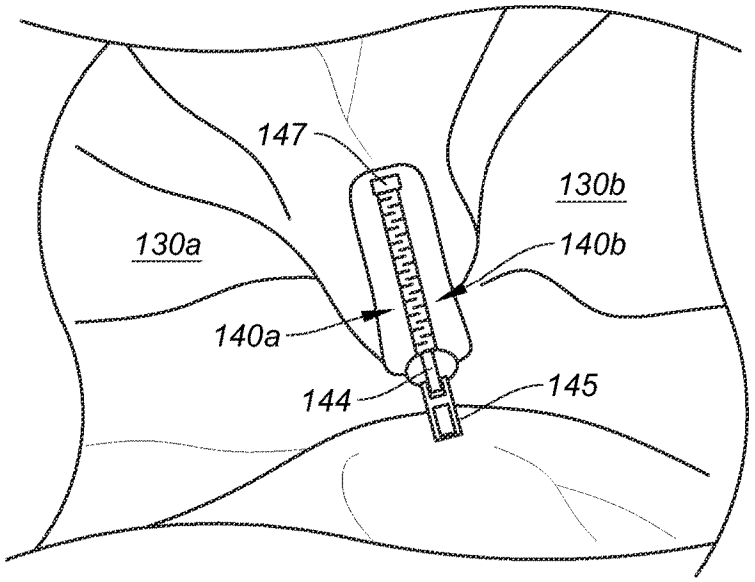
FIG. 9 is a view showing an intermediate step of stowing the base garment into the formed bag.
Figure 10:
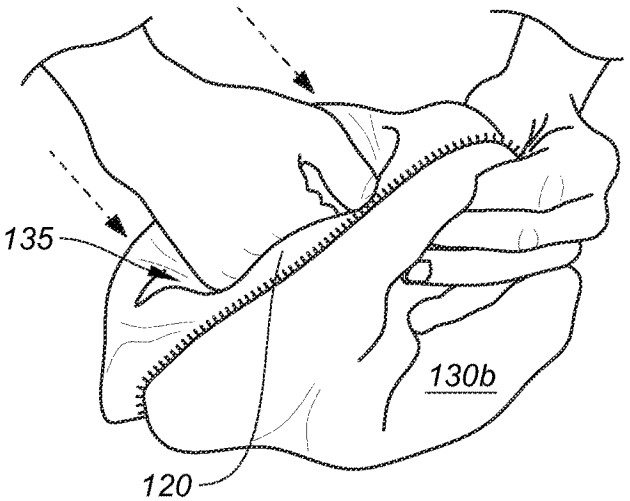
FIG. 10 is a view showing another intermediate step of stowing the base garment into the formed bag.
Figure 11:
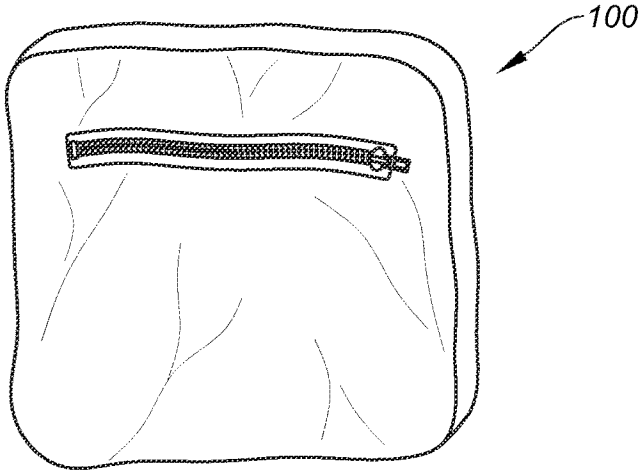
FIG. 11 is a front plan view of the formed bag with base garment contained therein.
Figure 12:
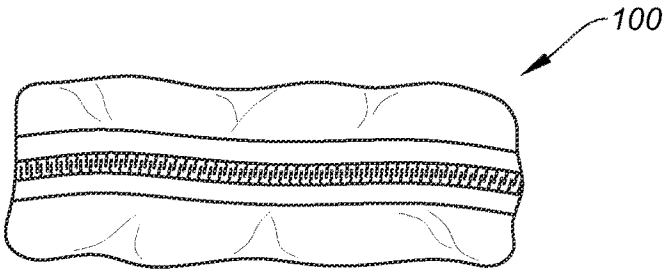
FIG. 12 is a top plan view of the formed bag with base garment contained therein.

Or closure, initially, only a few inches are zipped, as shown in FIG. 9, and then as the zipper fastener is pulled around the sides, a user begins to fold and stuff material parts of garment 120 into the temporary opening 135 formed between the unzipped portions of the mating halves 140*a/b* (opening 135 forming negative space within), as shown in FIGS. 9 and 10. Typically this is done gradually as the two pockets 130*a/b* are being zipped together, a little bit of the garment 120 being folded and are inserted into opening 135 at a time. This forms the stowed self-contained bag configuration of the convertible garment 100 as shown in FIGS. 11 and 12, the material of the base garment (the shorts 120 in this example) being folded for insertion in the bag.

Figure 13:
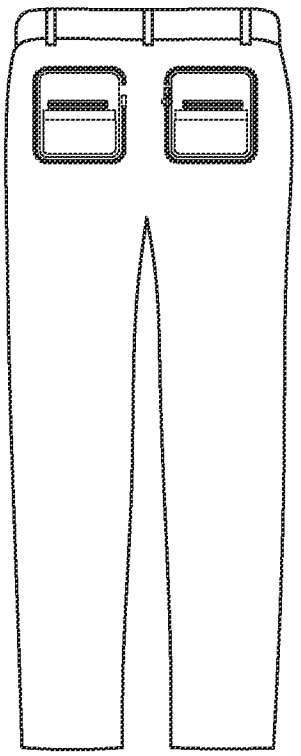
FIGS. 13-17 and 19 are exemplary base garments for inclusion of the example pocket structures to make each a convertible garment according to the example embodiments.
Figure 14:
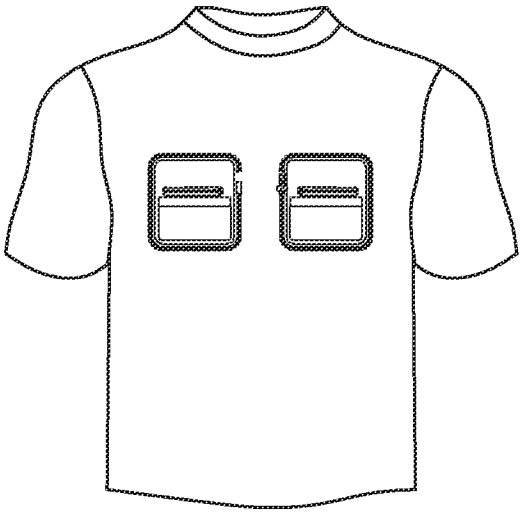
Figure 15:
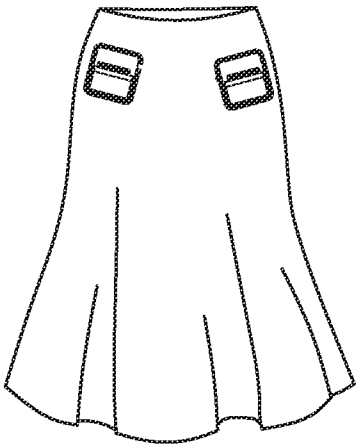
Figure 16:
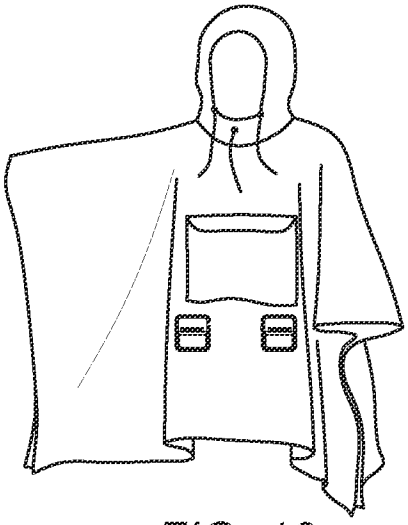
Figure 17:
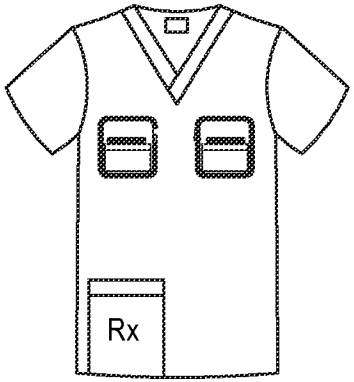

As previously noted, in one example, the convertible garment 100 includes a base garment 120 with a front panel containing the pockets 130*a/b* thereon. In another example, the convertible garment 100 includes a base garment 120 with a rear panel containing the pockets 130*a/b* thereon (see FIG. 13). In the case where the base garment 120 has sides, each pocket can be provided on a respective side.

In an example, the base garment 120 incorporated as part of the convertible garment 100 may be selected from a group comprising one or more of a shirt, a pair of shorts, a pair of pants, a skirt, a poncho, a jacket, underwear, or any other item wearable by a human being, such as hospital scrubs, uniforms, hats or caps, and the like.

Any type of fabric which is foldable into a smaller profile may be suitable for the above-described convertible garment and is not limited to any particular material of fabric. Almost all fabrics are variants or blends of just five basic fabric types (silk, cotton, linen, wool and worsted). Accordingly, materials suitable for the convertible garment include both man-made and natural materials for the fabric, and namely may include but are not limited to one or more (such as a combination) of cotton, silk, linen, satin, polyester, knit, wool, rayon, blends, lace, and leather/animal hides, and the like. The zipper fastener may be made of plastic or metal, alloys of metal, various synthetic composites, etc.

The example embodiments having been described, it is apparent that such have many varied applications. For example, FIGS. 5-12 illustrate a base garment 120 as a pair of shorts. The example embodiments are not limited to a single article of clothing. Namely, a convertible garment 100 as described herein is achievable by incorporating the pocket structure on any of a skirt, pants, convertible travel pants, shirts and dress shirts, dresses, underwear, ponchos, hospital scrubs, hats and caps, and the like. See for example FIGS. 13 to 17.

Figure 18:
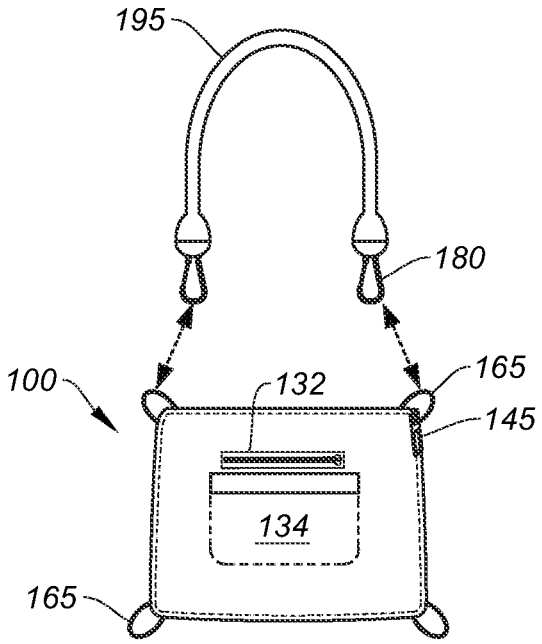
FIGS. 18 and 20 show example connection means for attaching a convertible garment in its stowed configuration to another item or article.
Figure 19:
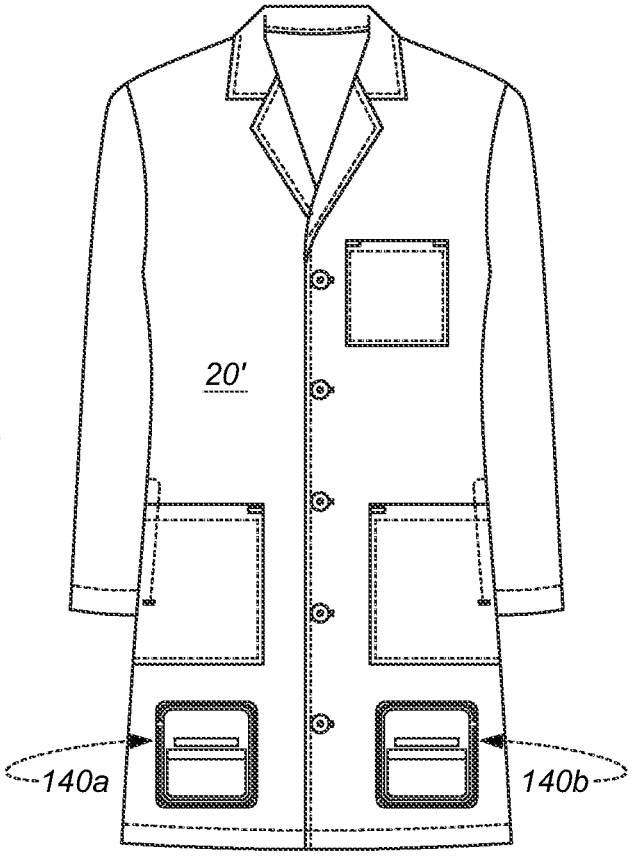
Figure 20:
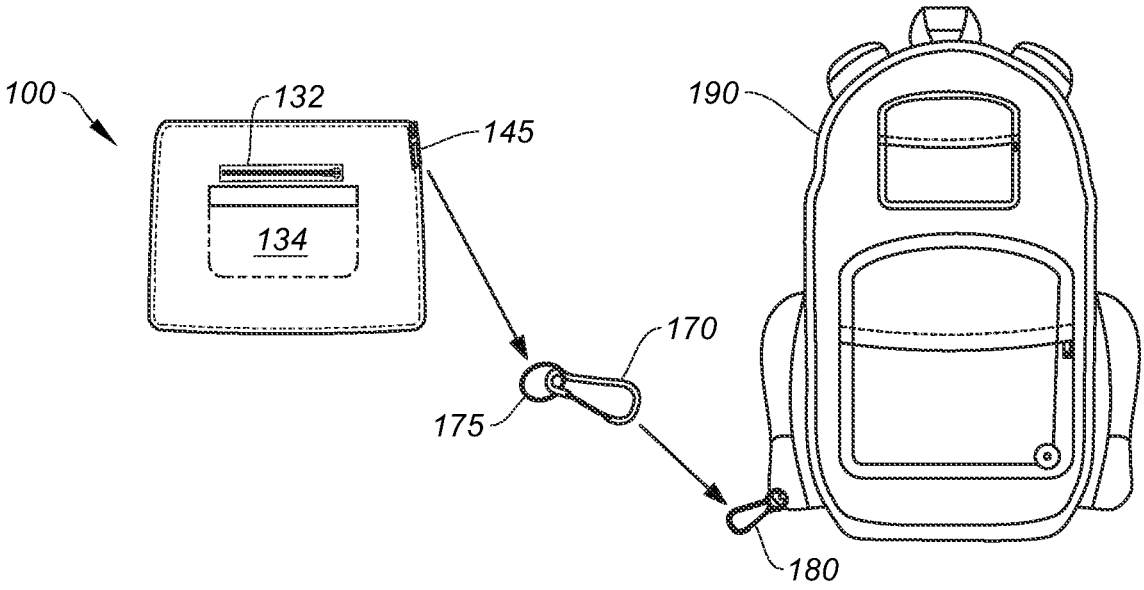

FIGS. 13-17 and 19 are exemplary base garments for inclusion of the example pocket structures to make each a convertible garment according to the example embodiments; and FIGS. 18 and 20 show example connection means for attaching a convertible garment in its stowed configuration to another article. Referring to these figures, the pocket structure is shown in various orientations, such as on a rear panel of a pair of pants (FIG. 13), on the sides or ribcage area of a shirt (see FIG. 14), or on a panel of a skirt (FIG. 15), on an outercoat or raingear (FIG. 16), on a hospital smock (FIG. 17), and the like for example.

FIG. 19 is a plan view of a lab coat showing a different configuration for a garment. Namely, only the zipper matting halves 140*a/b* are provided on an inside interior surface (shown in dotted lines to indicate an interior placement) of a garment 20' (lab coat here), there are no pockets 132, 134; the zipper halves are connectible via pull tab 145 on the inside thereof, and the material of lab coat 20' is gradually folded and inserted into a negative space formed by the chain of the zipper fastener, similar to as previously described, thereby achieving the convertible garment 100 in its bag configuration for stowage and/or travel.

An example stowage sequence may be as follows. Lay lab coat 20' flat and connect the zipper mating halves 140*a/b* on the inside flaps of coat 20' together, then zip up a few inches. Begin tucking material of the lab coat 20' in so as to lay flat and smooth. For this lab coat, 20', a user may start at the top and work downward, folding in the arms toward the middle, and continue the zipping procedure around corners until reaching the opening 135 formed in the negative space. Neatly roll and flatten the last bit of material of the lab coat 20' in from the bottom, flatten and then close zipper fastener to the stop 143 (not shown) to achieve the convertible garment 100 in its bag configuration.

The bag configuration of garment 100 further may be connected to other articles or items, such as is shown by example in FIGS. 18 and 20. FIG. 18 shows the convertible garment having a plurality of rings 165 (shown as a ring 165 on each corner, but could have one or multiple rings 165 at a corner or other location on convertible garment 100) for attachment to a clip, ring or carabiner 180 of a carrying strap 195; of course the rings 165 and clips 180 may be reversed with rings on the strap 195 and one or more clips 180 attached to convertible garment 100. In FIG. 20, the convertible garment 100 is shown as attachable to a clip or carabiner 170 via a ring 175, the clip or carabiner 170 further releasably attachable to another clip, ring or carabiner 180 on a backpack 190. Alternatively, the convertible garment 100 may be releasably attachable a piece of luggage, a fanny pack, or other article or item and the like as well.

The present invention, in its various embodiments, configurations, and aspects, includes components, systems and/or apparatuses substantially as depicted and described herein, including various embodiments, sub-combinations, and subsets thereof. Those of skill in the art will understand how to make and use the present invention after understanding the present disclosure. The present invention, in its various embodiments, configurations, and aspects, includes providing devices in the absence of items not depicted and/or described herein or in various embodiments, configurations, or aspects hereof, including in the absence of such items as may have been used in previous devices, e.g., for improving performance, achieving ease and\or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments, configurations, or aspects for the purpose of streamlining the disclosure. The features of the embodiments, configurations, or aspects of the invention may be combined in alternate embodiments, configurations, or aspects other than those discussed above. This method of disclosure is not to be interpreted as reflecting an intention that the claimed invention requires more features than are expressly recited in each claim. Rather, as the following claims reflect, inventive aspects lie in less than all features of a single foregoing disclosed embodiment, configuration, or aspect. Thus, the following claims are hereby incorporated into this Detailed Description, with each claim standing on its own as a separate preferred embodiment of the invention.

Moreover, though the description of the invention has included description of one or more embodiments, configurations, or aspects and certain variations and modifications, other variations, combinations, and modifications are within the scope of the invention, e.g., as may be within the skill and knowledge of those in the art, after understanding the present disclosure. It is intended to obtain rights which include alternative embodiments, configurations, or aspects to the extent permitted, including alternate, interchangeable and/or equivalent structures to those claimed, whether or not such alternate, interchangeable and/or equivalent structures disclosed herein, and without intending to publicly dedicate any patentable subject matter.

I claim:

1. A garment convertible into a bag for stowage and transport, comprising:

a base garment of a single-walled construction and having a front, a back and opposing sides, a pair of pockets, each of the two pockets having a single-walled construction and including a mating teeth halve of a zipper fastener arranged around an entire perimeter of the pocket and attached to the base garment, each pocket further having at least one opening between the base garment and material of the pocket within the perimeter bounded by the mating teeth halve, wherein the two pockets are joined by attaching the mating teeth halves of the zipper fastener so as to be zipped continuously around the connected pockets to form a bag therein, the material of the base garment adapted so as to be folded for insertion in the bag, and one or both pockets includes a separate zipper formed therein in addition to the pocket formed in the opening between the base garment and material of the pocket within the perimeter bounded by the mating teeth halve.

2. The garment of claim 1, wherein the base garment has a front panel, a rear panel and a pair of sides and one of the front panel, the rear panel and respective sides contains the pockets thereon.

3. The garment of claim 1, wherein the base garment is selected from a group comprising one or more of a shirt, a pair of shorts, a pair of pants, a skirt, a poncho, a jacket, underwear, or other item wearable by a human being.

4. The garment of claim 1, wherein a mating teeth halve on one pocket includes a slide body connected thereto and a pull tab connected to the slide body, and the mating teeth halve of the other pocket includes an insertion pin at a proximal end thereof for insertion into the slide body attached to the mating teeth halve of the one pocket so that the pockets can be attached together along the zipper chain, the zipper fastener zipping up the chain around the entire bag formed thereby and terminating at a pair of stops, each stop at a distal end of its corresponding mating teeth halve.

5. The garment of claim 1, wherein one or both of the base garment and pockets are made of a material selected from the group comprising at least cotton, silk, linen, satin, polyester, knit, wool, rayon, blends, lace, and animal hides.

6. The garment of claim 1, wherein the zipper fastener is made of one of a plastic, a metal, an alloy of metal, and a composite.

7. A garment convertible into a bag for stowage and transport, comprising:

a base garment made of a pliable and foldable material, a pair of pockets attached to the base garment, each of the two pockets made of the same pliable and foldable material as the base garment, the two pockets joined together with a zipper fastener that attaches mating teeth halves on the respective pockets so as to be zipped continuously around the connected pockets to form a bag therein, the material of the base garment adapted so as to be folded for insertion in the bag, one or both pockets having a separate zipper bag formed therein.

8. The garment of claim 7, wherein each mating teeth halve is arranged around its respective pocket on the base garment.

9. A garment convertible into a bag for stowage and transport, comprising:

a base garment of a single-walled construction and made of a given material, a pair of pockets attached to the base garment, each pocket made of the same material as the base garment with each pocket serving as an opening between the base garment and material of the pocket attached to the base garment, the two pockets joined together with a zipper fastener attaching the pockets together and zipped continuously around the connected pockets to form a bag therein, the given material of the base garment being adapted so as to be folded for insertion in the bag, wherein one or both pockets has a separate zipper bag formed therein.

10. The garment of claim 6, wherein the base garment and each pocket are made of the same material.

11. The garment of claim 1, wherein each pocket is made of a pliable and bendable material offering no stiffness or rigidity as the base garment is being folded for insertion in the bag.

12. The garment of claim 1, wherein the base garment includes a plurality of rings attached thereto so that upon the convertible garment being folded into a bag configuration for stowage and transport, the plurality of rings is presented on an exterior surface for attachment to a clip, another ring, or a carabiner of a separate article.

13. The garment of claim 7, wherein due to its material construction each pocket offers no stiffness or rigidity as the base garment is being folded for insertion in the bag.

14. The garment of claim 7, wherein the base garment includes a plurality of rings attached thereto so that upon the convertible garment being folded into a bag configuration for stowage and transport, the plurality of rings is presented on an exterior surface for attachment to a clip, another ring, or a carabiner of a separate article.

15. The garment of claim 8, wherein the base garment and each pocket are of single-walled construction.

16. The garment of claim 9, wherein due to its material construction each pocket offers no stiffness or rigidity as the base garment is being folded for insertion in the bag.

* * * * *